US005485889A

United States Patent [19]

Gray

[11] Patent Number: 5,485,889

[45] Date of Patent: Jan. 23, 1996

[54] STEERING DRILL BIT WHILE DRILLING A BORE HOLE

[75] Inventor: Benjamin Gray, Silver Valley, Canada

[73] Assignee: Sidekick Tools Inc., Silver Valley, Canada

[21] Appl. No.: 400,106

[22] Filed: Mar. 3, 1995

Related U.S. Application Data

[63] Continuation-in-part of Ser. No. 279,348, Jul. 25, 1994, abandoned.

[51] Int. Cl.[6] ..... E21B 7/04

[52] U.S. Cl. ..... 175/61; 175/73

[58] Field of Search ..... 175/61, 73, 74, 175/69, 71, 324, 215

[56] References Cited

U.S. PATENT DOCUMENTS

| | | | |
|---|---|---|---|
| 2,548,616 | 4/1951 | Priestman et al. | 175/203 X |
| 3,566,980 | 3/1971 | Scroggins | 175/65 |
| 3,777,827 | 12/1973 | Thiery et al. | 175/103 |
| 3,848,685 | 11/1974 | Takagi et al. | 175/103 X |
| 3,856,095 | 12/1974 | Adair et al. | 175/203 |
| 3,872,932 | 3/1975 | Gosselin | 175/103 |
| 3,941,146 | 3/1976 | Chatard et al. | 175/103 X |
| 4,374,547 | 1/1983 | Nguyen et al. | 175/45 |
| 4,735,270 | 4/1988 | Fenyvesi | 175/203 X |
| 5,215,151 | 6/1993 | Smith et al. | 175/45 |
| 5,265,687 | 11/1993 | Gray | 175/62 |
| 5,311,952 | 5/1994 | Eddison et al. | 175/61 |
| 5,316,093 | 5/1994 | Morin et al. | 175/74 |
| 5,339,913 | 8/1994 | Rivers | 175/73 |
| 5,360,075 | 11/1994 | Gray | 175/61 |
| 5,375,669 | 12/1994 | Cherrington | 175/69 X |
| 5,411,105 | 5/1995 | Gray | 175/69 |
| 5,435,400 | 7/1995 | Smith | 175/61 |

FOREIGN PATENT DOCUMENTS

| | | | |
|---|---|---|---|
| 1167285 | 4/1964 | Germany . | |
| 2262758 | 6/1973 | Germany . | |
| 3751564 | 5/1978 | Germany . | |
| 878895 | 11/1981 | U.S.S.R. | 175/61 |
| 9005235 | 5/1990 | WIPO | 175/61 |

OTHER PUBLICATIONS excerpt from Oilweek—Aug. 2,1976 (2 pages).
clipping from The Roughneck—Jul. 1976.
clipping from newspaper entitled "Idea of oilman Ben Gray".
clipping from Edmonton Journal—Aug. 22, 1978.

*Primary Examiner*—Hoang C. Dang
*Attorney, Agent, or Firm*—Adrian D. Battison; Murray E. Thrift

[57] ABSTRACT

A drilling system for controlling steering of a downhole drilling tool includes a shallow bend in the drilling tool and a system for rotating the bent drilling tool slowly about a longitudinal axis of the drilling tool while the drill bit rotates more rapidly. The system further allows the slow rotation to be halted at a predetermined orientation of the bend axis so as to effect a change in drilling direction. The system for rotating and halting this slow rotation comprises a downhole swivel coupling between the drilling tool and the drill string so that torque from the drill bit tends to rotate the drilling tool in the opposite direction. A control device is provided to restrict the amount of torque communicated through the swivel coupling and to halt the swivel coupling as required to control the steering of the drill bit.

16 Claims, 3 Drawing Sheets

STEERING DRILL BIT WHILE DRILLING A BORE HOLE

This application is a continuation-in-part of application Ser. No. 08/279,348, filed Jul. 25, 1994 which is now abandoned.

BACKGROUND OF THE INVENTION

This invention relates to a method of drilling a bore hole using a drill bit and more particularly to a method of steering the drill bit while drilling a bore hole to control the direction of drilling.

It is previously known that a substantially vertical well bore can be turned with a short radius curved section into an inclined or horizontal well bore by providing a drilling tool which includes a bend section defining a transverse bend axis between a forward drill bit support portion and a trailing motor portion. The bend section of the drilling tool tends to steer the well bore so that it turns to a direction at right angles to a plane containing the bend axis. One particular example of this technique is disclosed in my U.S. Pat. No. 5,265,687. In this patent I also proposed that the bore be continued in a horizontal direction after the curved section is complete by adding shims to the underside of the drilling tool.

A method is disclosed in U.S. Pat. No. 5,215,151 (Smith et al) in which the drilling of a bore hole is effected using continuous coiled tubing which extends from a trailing end on a supply reel at the earth's surface to a leading end within the well bore.

The drilling of well bores using continuous coiled tubing is known conventionally and includes the supply of a drilling fluid which is pumped into the trailing end of the coiled tubing for transmitting the drilling fluid to the leading end of the tubing at the base of the well bore. At the base is provided a drilling tool which includes a drill bit rotatable relative to the drilling tool, the drill bit being driven by a motor powered by the flow of the drilling fluid through the drilling tool.

it is also previously known that, when drilling a horizontal bore section, the horizontal direction can be better maintained by slowly rotating the drilling tool with the bend section so that the bend section rotates about the longitudinal axis of the drilling direction at a rate less than that of the drill bit.

The above U.S. patent of Smith discloses a technique of steering the drilling tool to vary the azimuth of the curved bore section by providing an orientation device as a part of the drilling tool. The drilling tool thus comprises an upper part fixed relative to the drill tubing and a lower part including the drill bit and the bend section. A control motor system is provided by which the lower section can be rotated relative to the upper section in indexed steps of controlled predetermined amounts in response to motive force provided from the surface in the form of pulses in the drilling fluid.

A similar arrangement is disclosed in U.S. Pat. No. 5,311,952 of Eddison et al which uses an indexing device that is actuated by mud pulses but this in addition states that the reactive torque from the drill bit assists in effecting the rotation in the indexing direction.

These arrangement are generally satisfactory and have achieved some success but are relatively complex involving signaling from the surface and relatively complex mechanical structures in the drilling tool. It is also necessary to halt the drilling action and to lift the weight off the drill bit during the indexing step and therefore it is not possible to use this technique for slowly rotating the drilling tool while the drilling continues.

More recently designs of slowly rotating down-hole motors are currently being proposed which can also be commanded from the surface to start and stop to control changes in direction. However these have the disadvantages that it is difficult to convey power from the surface and also it is difficult to provide enough torque to turn the complete tool while drilling without putting too much torque on the coiled tubing, as this is susceptible to damage if over torqued.

It has also been proposed to steer the drilling tool by rotating the injector about the axis of the drill string. This acts to rotate the tubing which in turn rotates the drilling tool to the required angle. An improvement to this technique is disclosed in co-pending application Ser. No. 158,830 of the present inventor filed Nov. 23, 1993, now U.S. Pat. No. 5,360,075.

SUMMARY OF THE INVENTION

It is one object of the present invention, therefore, to provide an improved drilling method which enables effective control of the drilling direction of a bore hole while avoiding the necessity for communicating significant power from the surface to the downhole control system and avoiding the possibility of applying excess torque to the drill string.

According to a first aspect of the invention there is provided a method of drilling a bore hole in the earth comprising: providing a drill string having a trailing end at ground level and a leading end for insertion into the bore hole; connecting a supply of drilling fluid to the trailing end for pumping the drilling fluid to the leading end; providing a drilling tool having an elongate tool body defining a longitudinal axis therealong, providing a motor mounted on the tool body to generate drive power, providing a drill bit mounted on the tool body at a leading end thereof for rotation of the drill bit in an angular direction relative to the tool body about the longitudinal axis in responsive to the drive power from the motor, and providing means forming a bend section in the tool body defining a bend axis of the tool body transverse to the longitudinal axis of the tool body such said rotation of the drill bit tends to steer a longitudinal drilling direction of the tool body in a direction at an angle to a plane containing the bend axis and the longitudinal axis; connecting a trailing end of the drilling tool body to the leading end of the drill string so as to communicate drilling fluid from the drill string to the tool body to cause rotation of the drill bit; in order to form a straight section of the bore hole, allowing counter-rotation of the tool body relative to the leading end of the drill string in an angular direction opposite to the angular direction of the drill bit in response to torque generated at the drill bit so as to cause rotation of the tool body and the transverse bend axis about the longitudinal axis, with motive force for the counter-rotation being provided by the torque from the drill bit, and controlling the counter-rotation to be maintained during the formation of the straight section at a rate less than that of the rotation of the drill bit; and, in order to steer the longitudinal drilling direction by forming a curved section of the bore hole, occasionally halting the counter-rotation to hold the bend axis at a predetermined orientation.

Preferably the control means comprises a hydraulic pump system which is connected between the drill string and the drilling tool so as to cause fluid flow around a closed loop to provide a resistance to the rotation between the drill string and the drilling tool. In this way only a controlled amount of the torque generated between the motor and the drill bit is used to effect the counter-rotation while the remainder effects the normally required rotation between the drill bit and the bore to effect the drilling action. This control of the torque limits the counter-rotation to a rate less than that of the drill bit. In addition the pump system includes a valve actuable from the surface to halt the fluid flow to lock up the counter-rotation thus holding the bend axis in a specific orientation to effect a change in drilling direction.

While specifically disclosed herein as a hydraulic pump system, the function of the control means can be effected by other arrangements including, but not limited to a friction brake; a fluid coupling with a friction brake; an indexing system such as a ratchet or indexing pins which allow the counter-rotation to proceed at only a predetermined rate regardless of the magnitude of the torque; or any combination of these techniques.

According to a second aspect of the invention there is provided a method of drilling a bore hole in the earth wherein the bore hole includes a first substantially straight portion extending from ground level to a first below ground location and a curved portion extending from the first below ground location to a second below ground location, the method comprising: providing a drill string having a trailing end at ground level and a leading end for insertion into the bore hole; connecting a supply of drilling fluid to the trailing end for pumping the drilling fluid to the leading end; providing a drilling tool having an elongate tool body defining a longitudinal axis therealong, providing a motor mounted on the tool body to generate drive power, providing a drill bit mounted on the tool body at a leading end thereof for rotation of the drill bit in an angular direction relative to the tool body about the longitudinal axis in responsive to the drive power from the motor, and providing means forming a bend section in the tool body defining a bend axis of the tool body transverse to the longitudinal axis of the tool body such said rotation of the drill bit tends to steer a longitudinal drilling direction of the tool body in a direction at an angle to a plane containing the bend axis and the longitudinal axis; connecting a trailing end of the drilling tool body to the leading end of the drill string so as to communicate drilling fluid from the drill string to the tool body to cause rotation of the drill bit; in order to form a straight section of the bore hole extending from the second below ground location, causing counter-rotation of the tool body relative to the leading end of the drill string in an angular direction opposite to the angular direction of the drill bit so as to cause rotation of the tool body and the transverse bend axis about the longitudinal axis, and providing control means for controlling the counter-rotation to be maintained during the formation of the straight section at a rate less than that of the rotation of the drill bit; wherein the control means is located in the first substantially straight portion spaced downwardly from the ground surface and is interconnected to the tool body by a length of tubing extending through the curved section such that the length of tubing counter-rotates with the tool body relative to the drill string and relative to the curved section of the bore hole.

According to a third aspect of the invention there is provided a method of drilling a bore hole in the earth wherein the bore hole includes a first substantially vertical straight portion extending from ground level to a first below ground location and a curved portion extending from the first below ground location to a second below ground location, the method comprising: providing a drill string having a trailing end at ground level and a leading end for insertion into the bore hole; connecting a supply of drilling fluid to the trailing end for pumping the drilling fluid to the leading end; providing a drilling tool having an elongate tool body defining a longitudinal axis therealong, providing a motor mounted on the tool body to generate drive power, providing a drill bit mounted on the tool body at a leading end thereof for rotation of the drill bit in an angular direction relative to the tool body about the longitudinal axis in responsive to the drive power from the motor, and providing means forming a bend section in the tool body defining a bend axis of the tool body transverse to the longitudinal axis of the tool body such said rotation of the drill bit tends to steer a longitudinal drilling direction of the tool body in a direction at an angle to a plane containing the bend axis and the longitudinal axis; connecting a trailing end of the drilling tool body to the leading end of the drill string so as to communicate drilling fluid from the drill string to the tool body to cause rotation of the drill bit; forming a substantially horizontal straight section of the bore hole extending from the second below ground location; transporting in the drill string a gas and injecting the gas into the bore hole from the drill string within the first straight section of the bore hole adjacent the first below ground location.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
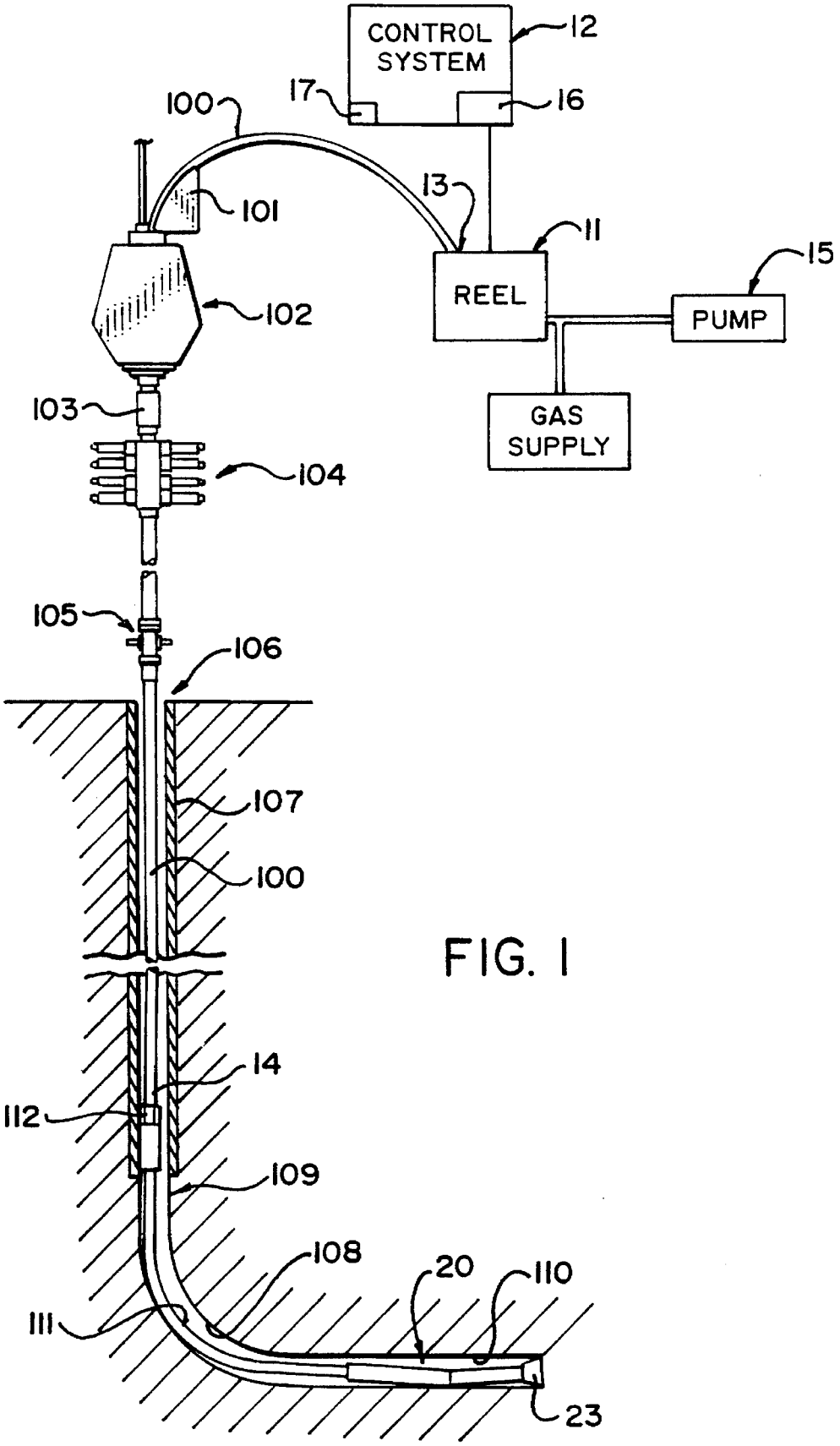
FIG. 1 is a schematic side elevational view of a drilling system including the ground level control system and the downhole drilling tool.

The arrangement of the present invention is based on my above U.S. Pat. No. No. 5,265,687, the disclosure of which is incorporated herein by reference. In particular the down hole drilling tool as shown schematically in FIG. 1 is taken from the disclosure of the above patent. In addition FIG. 1 also includes the above ground construction which is shown schematically for completeness.

The apparatus therefore includes a drill tubing which as shown can comprise coiled tubing 100 supplied from a reel (not shown) over a guide arch 101. From the arch 101, the tubing enters an injector schematically indicated at 102 which is again of a conventional nature and acts to grasp the tubing using blocks which frictionally engage the tubing and force the tubing longitudinally both in the downward or the upward direction for feeding and withdrawing the tubing into the well bore. The construction of the injector is well known and this also acts to hold the tubing against rotation in a twisting direction so that the tubing is fed directly longitudinal without any twisting about its axis. In one known arrangement of the injector the tubing is grasped by opposed blocks, each of which has a front face of semi-cylindrical shape so that together the blocks form the majority of a cylinder surrounding the tubing. A plurality of the blocks are then mounted in two rows carried on a pair of opposed chains and movable thereby longitudinally of the well bore. The blocks are biased into engagement with the tubing by guide plates.

From the injector, the tubing passes into the well bore through a stripper 103, a blow out protector (BOP) 104 and a lubricator 105 to the well head 106. The stripper, BOP and lubricator are of a well known and conventional nature and are therefore shown only schematically and will not be described in detail herein. In an arrangement wherein the well bore is an existing producing well in which it is required to drill an extra horizontal section to increase production, the well includes an existing casing 107 in a substantially vertical portion of the well at the well head 106.

My U.S. Pat. No. 5,265,687 describes the technique for drilling the short radius curved section 108 at or adjacent a bottom end 109 of the vertical portion. The present invention is particularly concerned with a method for controlling the drilling of a horizontal straight section 110 of the well bore at the remote end of the curved portion 108.

The system at ground level includes a reel 11 for the coiled tubing 100 so that the coil tubing has an upper end 13 attached to the reel and a lower end 14 attached to the drilling tool generally indicated at 20. A drilling fluid pump 15 supplies drilling fluid into the upper end 13 of the coil tubing at the reel for transmitting the drilling fluid through the coil tubing to the down hole drilling tool 20. In addition at the ground level there is provided a control system 12 which includes a display 16 for receiving information from downhole transducers and a control system including a valve control 17 for supplying downhole control data to the drilling tool.

Figure 2:
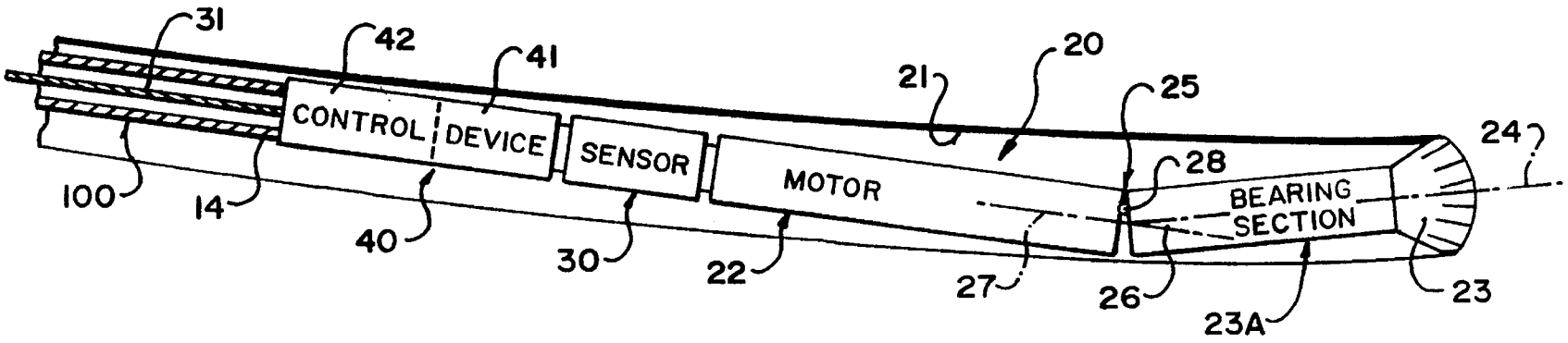
FIG. 2 is a side elevational view of the down hole drilling tool only of a system similar to that of FIG. 1 in which the control device is arranged immediately adjacent the tool body.

The downhole drilling tool 20 is shown in larger scale in FIG. 2 and includes a conventional motor 22 which is preferably of the type driven by the flowing drilling fluid for generating a rotational movement which is communicated to the drill bit 23 for rotation of the drill bit in a bearing section 23A about a longitudinal axis 24 of the drill bit. In the arrangement shown, the motor is attached to the bearing section of the drill bit by a knuckle 25 which provides a shallow bend angle 26 between a longitudinal axis 27 of the motor and the longitudinal axis 24 of the drill bit. This bend angle is obtained by cranking the drill bit about a transverse axis 28 at right angles to the longitudinal axis 24 and 27. In the position shown, therefore, the drill bit will have a tendency to drill upwardly that is in a direction generally at right angles to the transverse bend axis 28 and on the side of the longitudinal axis 24 opposite to the angle 26.

It is well known that a bent drilling tool of this type can be used to drill horizontal bore holes by slowly rotating the drilling tool including the motor and the drill bit about the longitudinal axis of the drill bit so that the axis 28 gradually rotates about the axis 24. This gradual rotation of a bent drilling tool provides more accurate control over the horizontal orientation than would simply providing a straight drilling tool and maintain that straight drilling tool in the fixed horizontal orientation.

It is further known, in the event that the drilling tool deviates from the required direction, the direction of drilling can be controlled by halting the slow rotation of the drilling tool about the axis 24 and holding the bend axis 28 at a required orientation so as to direct the drill bit in the required direction to overcome the inaccuracy in the drilling. In this way the bend axis 28 can be maintained stationary for sufficient period of time to regain the required direction of drilling. A sensor unit is schematically indicated at 30 which is used to detect the orientation of the drilling tool during drilling to detect and control deviations from the required direction drilling.

The sensor 30 is of conventional construction and accordingly shown only schematically. The sensor 30 communicates through a communication system 31 shown schematically as a cable passing through the coil tubing for communicating information to the display 16.

It is further well known and readily apparent that the rotation of the drill bit in engagement with a drill face of the hole to be drilled generates torque in the drilling tool tending to twist the coiled tubing. This torque must be resisted by the coil tubing in order to generate the rotation of the drill bit relative to the drill face.

The present invention is directed to the problem of providing a motive force and control for effecting the relatively slow rotation of the drilling tool about the longitudinal axis of the drill bit. In the present invention, therefore, there is provided an additional control device schematically indicated at 40 which is located between the drilling tool 20 and the coiled tubing 100.

In FIG. 1, the control device is located at or adjacent the lower end of the vertical portion of the well and is connected to the drilling tool body by a length of tubing 111 which extends through the lowermost part of the vertical portion and through the curved portion to the required position of the horizontal section. The length of the tubing 111 is selected so that the control device remains in the vertical portion within the casing 107 while the tool moves to drill the curved portion and the required length of the horizontal section.

In FIG. 2, the arrangement is modified so that the control device is located immediately at or adjacent the drilling tool.

Figure 3:
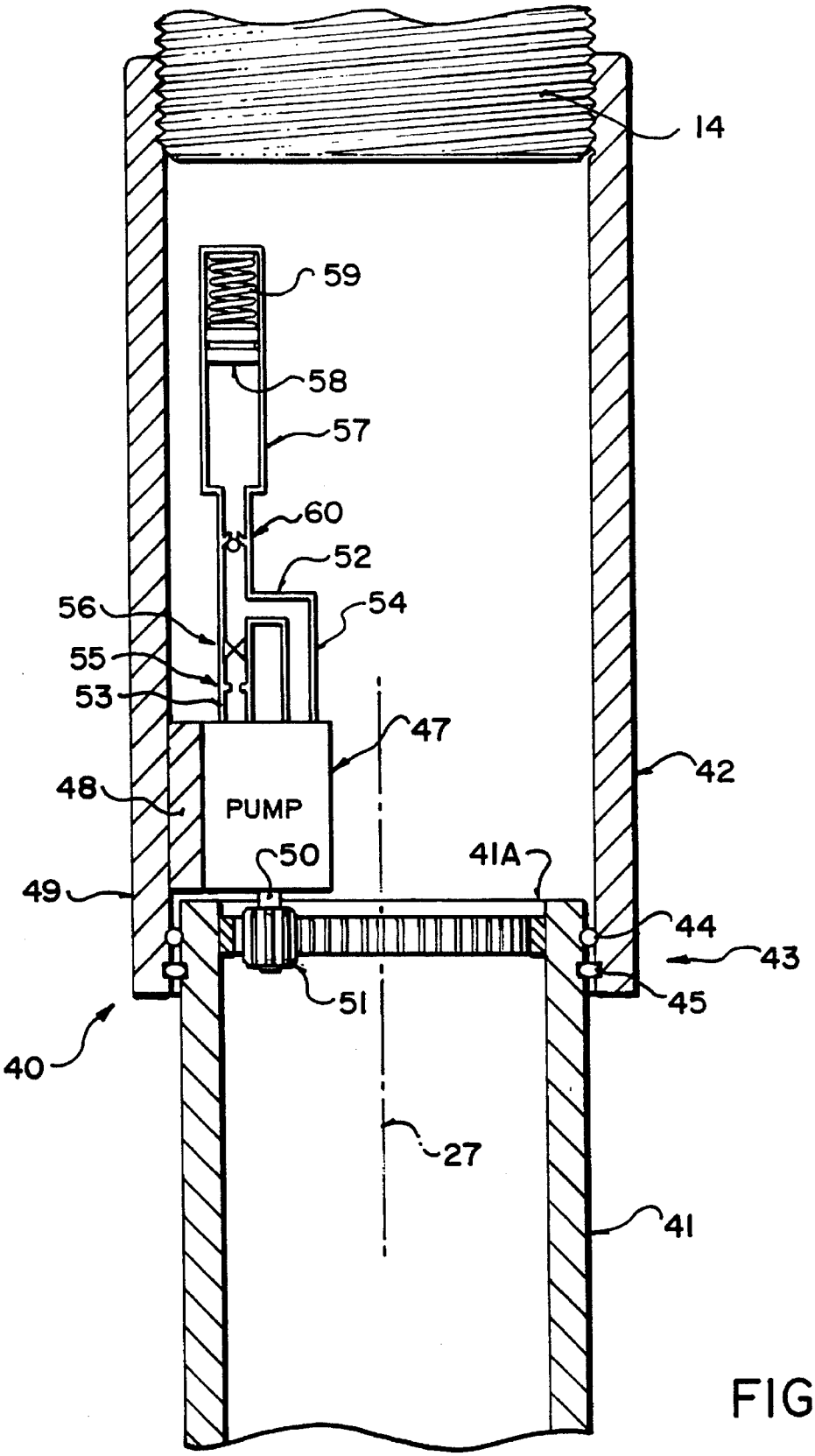
FIG. 3 is a cross sectional view through the control device of FIG. 1 or FIG. 2.

The details of the control device are shown in FIG. 3 wherein the control device includes a downstream portion 41 and an upstream portion 42 with a downstream portion 41 connected to the drilling tool by conventional connection systems and the upstream portion 42 is connected to the coil tubing as schematically indicated at 14. The portion 41 is connected to the portion 42 by a swivel coupling assembly 43 including an annular bearing 44 and a seal 45. The portions 41 and 42 thus form an annular interconnection which allows rotation about the longitudinal axis 27 of the motor 22. In the example shown both of the portions 41 and 42 comprise a cylindrical member with an end of the portion 41 inside the adjacent end of the portion 42 so that the bearing and seal are located in the cylindrical area therebetween.

On the inside surface of the end 41A of the portion 41 is provided a ring gear 46 fixed to the end 41A so as to be rotatable therewith. A pump 47 is mounted by a bracket 48 on the inside of the end 49 of the portion 42. The pump carries a drive shaft 50 on which is mounted a pinion 51 rotatable in the ring gear 46. Thus rotation between the portion 41 and 42 effects rotation of the pinion relative to the ring gear so as to drive the pinion 51 and thus to drive the fluid pump 47.

The pump includes a closed circuit 52 so that output pressure from the pump on a line 53 passes through the circuit 52 and returns to an inlet 54 of the pump. The fluid circuit includes an orifice 55 which acts as a restriction to flow thus providing a back pressure on the pump 47. The fluid circuit further includes a control valve 56 which is operable to halt the flow of fluid through the circuit 52. The circuit further includes a top up reservoir 57 with a piston 58 and the spring 59 for supplying top up fluid into the circuit should any leaks cause a loss in the fluid. A backcheck valve 60 prevents the pressure in the circuit 52 from entering the reservoir 57 if reverse torque is inadvertently applied for a short time.

The connection between the portions 41 and 42 through the bearing 44 therefore provides effectively free rotation of the drilling tool relative to the drill string provided by the coil tubing. Rotation of the motor therefore will effect a driving force to the drill bit but that driving force will also generate a counter-rotation in the drilling tool caused by the torque between the drill bit and the drill face. As there is free rotation between the portions 41 and 42, this counter-rotation will be taken up in the bearing connection therebetween and will therefore normally allow this free counter rotation to prevent rotation of the drill bit.

In order to restrict this free rotation, therefore, the pump 47 and the closed circuit 52 are provided which acts as a restriction on this free rotation with that restriction being controlled or determined by the resistance to flow provided by the orifice 55. The orifice is selected therefore to provide a predetermined resistance to rotation at the connection between the portions 41 and 42 with that resistance to rotation being sufficient to accommodate a portion of the torque generated by the drill bit so the drill bit rotates but also the motor rotates in counter rotation about the axis 27. The resistance to flow in the circuit 52 is further arranged so that the rate of rotation of the motor about the axis 27 is significantly slower than the rate of rotation of the drill bit. This arrangement can therefore be predetermined so that the required slow rotation of the drilling tool about the axis 27 is obtained while the drill bit rotates more quickly to effect the drilling action. Normally with a predetermined loading on the drill bit and a predetermined rate of rotation of the drill bit, the required restriction to flow can be precalculated to obtain the required relative rotations of the drilling tool about the axis and the drill bit about its axis. The selection of a predetermined orifice in the circuit thus effectively sets a maximum rate which is dependent upon the torque from the drill bit. The orifice can also be changed to vary the maximum rate.

In addition the valve 56 can be actuated through the control cable 31 so that the circuit 52 is fully closed thus preventing rotation of the pump 47 which is of the positive displacement type. In this way the pump acts to lock the pinion on the gear wheel thus locking the portions 41 and 42 in fixed position. When so fixed, the rotation of the drilling tool about the axis 27 is halted and all of the rotation is effected through the drilling bit without any counter-rotation. The valve can be actuated at a required position of the bend axis 28 so as to direct the tendency of the drill bit to turn in the required direction to correct any steering errors.

The rotation of the drilling tool is therefore obtained by extracting from the normal rotation of the drill bit a smaller portion of the torque to provide a motive force for the counter-rotation. There is no necessity therefore for any supply of additional motive force from the surface, from battery power or the like. Furthermore, the absorption of some of the torque to the drill bit in the counter-rotation reduces the torque on the drill string. With the drill string designed and manufactured to accommodate the maximum torque which can be generated by the motor, the drill string can certainly accommodate the reduced torque which is obtained a portion of that torque is communicated through the junction of the control device 40. There is little or no possibility therefore of over torquing the drill string thus avoiding the potential for damage which can be effected by conventional downhole drive motors.

As the rotation of the drilling tool is obtained as a counter-rotation generated wholly by the torque from the drill bit, there is no necessity for any pulses to be supplied from the ground surface to control an indexing device. The mud pressure can therefore be maintained constant and the mud flow rate also remains constant so the drilling continues at a constant rate and at a constant torque on the drill bit. In addition the rotation of the drilling tool is at a constant rate which provides the required proper control of the drilling direction by smoothly rotating the drilling tool at the constant rate as previously described.

In the arrangement shown in FIG. 1, the control device 40 is located in the casing at the lower end of the vertical portion of the weld bore. The control device is then connected to the drilling tool body itself by the length of tubing 111. In effect, therefore, the drilling tool comprises the control device, the length of tubing and the tool body itself. As previously described, therefore, the lower part of the control device together with the tool body rotate within the well bore and this rotation is of course communicated through and includes rotation of the tubing 111.

in drilling the horizontal section of the hole there is considerable friction where the tubing goes through the curved portion of the hole which dramatically reduces the penetration rate. For example, if the system is drilling with 3000 pounds pressure vertically downwardly on the drill string, there is between 2000 pounds and 3500 pounds of friction to move the tubing through the curved portion. It will be appreciated in this regard that the downward pressure on the drill string applies a significant force pressing the tubing 111 against the outside curvature of the curved portion of the well. Because of this high and variable friction, it is impossible to keep a constant weight on the bit. Thus the bit can drill off completely so that there is no pressure on the drill bit in a situation where the friction exceeds the downward pressure on the drill string. In this situation the drill string can then slip through the curved section to reapply some pressure at the bit. This variation in the pressure on the bit from very little or no pressure up to a higher pressure which is less than the vertical pressure on the drill string reduces the efficiency of the drilling action. In addition the variations in pressure on the drill bit of course vary the torque generated by the drill bit so that there is a tendency to vary the windup in the drill string.

This linear friction through the curved portion of the well bore can be practically eliminated by continuous rotation of the tubing 111 through the curved bore section where the friction exists.

Reference is also made to my co-pending application, Ser. No. 260,365, filed Jun. 14, 1994 and entitled DRILLING A WELL GAS SUPPLY IN THE DRILLING LIQUID, now U.S. Pat. No. 5,411,105 a disclosure of which is incorporated herein by reference. In this application there is disclosed a method of underbalanced drilling in which a gas is carried through a portion of the drill string tubing and is released into the well bore at a position adjacent the drilling tool. In the present arrangement, the gas is released at a discharge vent 112 immediately adjacent the control device 40. This therefore releases the gas at a position within the vertical portion of the well bore and within the casing 107. This arrangement avoids the possibility of erosion of the well bore in a situation where the fluid in the bore has an increased velocity due to the addition of the gas. The gas therefore is injected into the well bore at the casing without the possibility of erosion in view of the existence of the casing at that position and yet the supplying of the gas reduces the hydrostatic head of the fluid within the well bore to allow underbalanced drilling. In the curved and horizontal portions of the well bore which do not have any casing, the drilling fluid consists solely of the pure liquid so that the velocity of the liquid through the well bore is reduced or at a conventional level to avoid the detrimental effects of the high velocity fluid. The arrangement of FIG. 1 is installed and operated using the following process. Firstly the bit and motor on the drilling tool are fed into the hole with a check valve within the drill string to prevent fluid from flowing up the tubing from the producing well. This part of the tubing which constitutes the tubing 111 is of a length sufficient to drill the desired distance horizontal as well as to pass through the curved portion and into the vertical portion of the well. This portion of the tubing can be run from the main tubing supply reel 13 or from a separate or auxiliary reel if large diameter tubing is used for deep well drilling. The tubing 111 is then held by the slips in the BOP 104 and is released by the injector 102. The injector can then be lifted hydraulically by the lift system (not shown) to allow enough room to attach the control device 40 and the discharge device 112. The coil tubing 100 from the reel 13 is then brought through the injector and attached to the top of the control device 40. The tubing 100 is then fed into the hole to move the tool to the bottom of the hole to commence drilling of the curved portion. This procedure can easily be done with available equipment while there is pressure in the existing production well.

The control device as shown in the present arrangement includes the motor which restricts the counter-rotation of the control device to a predetermined rate. However it will be appreciated that in alternative arrangements the motor can be replaced by other devices which act to restrict the rate of counter-rotation to a predetermined rate. Such arrangements can include elements which utilize friction as the force for restricting the rotation or can use arrangements which utilize a stepping action. The basic concept is that the control device allows the counter-rotation to occur in response to the torque from the drill bit but then controls that counter-rotation to a predetermined substantially constant rate slower than that of the drill bit or to stop that counter-rotation when desired. For example, the rotation can be restricted by a friction brake which is controlled by an arrangement similar to that of the anti-lock brakes of a motor vehicle Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of drilling a bore hole in the earth comprising:

providing a drill string having a trailing end at ground level and a leading end for insertion into the bore hole;

connecting a supply of drilling fluid to the trailing end for pumping the drilling fluid to the leading end;

providing a drilling tool having an elongate tool body defining a longitudinal axis therealong, providing a motor mounted on the tool body to generate drive power, providing a drill bit mounted on the tool body at a leading end thereof for rotation of the drill bit in an angular direction relative to the tool body about the longitudinal axis in responsive to the drive power from the motor, and providing means forming a bend section in the tool body defining a bend axis of the tool body transverse to the longitudinal axis of the tool body such said rotation of the drill bit tends to steer a longitudinal drilling direction of the tool body in a direction at an angle to a plane containing the bend axis and the longitudinal axis;

connecting a trailing end of the drilling tool body to the leading end of the drill string so as to communicate drilling fluid from the drill string to the tool body to cause rotation of the drill bit;

in order to form a straight section of the bore hole, allowing counter-rotation of the tool body relative to the leading end of the drill string in an angular direction opposite to the angular direction of the drill bit in response to torque generated at the drill bit so as to cause rotation of the tool body and the transverse bend axis about the longitudinal axis, with motive force for the counter-rotation being provided by the torque from the drill bit, and controlling the counter-rotation to be maintained during the formation of the straight section at a rate less than that of the rotation of the drill bit;

and, in order to steer the longitudinal drilling direction by forming a curved section of the bore hole, occasionally halting the counter-rotation to hold the bend axis at a predetermined orientation.

2. The method according to claim 1 wherein the counter-rotation is substantially constant during the formation of the straight section.

3. The method according to claim 1 wherein the drilling fluid is supplied at a substantially constant rate during the formation of the straight section.

4. The method according to claim 1 wherein the whole of the motive force for the counter-rotation is provided by the torque from the drill bit,

5. The method according to claim 1 wherein the counter-rotation is controlled by resisting the rate of rotation to a predetermined variable maximum rate dependent upon the torque from the drill bit.

6. The method according to claim 5 wherein the rotation is resisted by two intermeshing gears connected respectively to the tool body and to the drill string and means for limiting the rate of rotation of one of the gears.

7. The method according to claim 6 wherein the limiting means comprises a pump driven by said one of the gears and flow restrictor means restricting flow of the fluid pumped by the pump.

8. The method according to claim 1 including providing control means for controlling the counter-rotation and locating the control means immediately adjacent the tool body.

9. The method according to claim 1 wherein the bore hole includes a first substantially straight portion extending from ground level to a first below ground location and a curved portion extending from the first below ground location to a second below ground location, wherein the straight section extends from the second below ground location, wherein there is provided control means for controlling the counter-rotation and wherein the control means is located in the first substantially straight portion spaced downwardly from the ground surface and is interconnected to the tool body by a length of tubing extending through the curved section such that the length of tubing counter-rotates with the tool body relative to the drill string and relative to the curved section of the bore hole.

10. The method according to claim 9 wherein the drill string includes means for transporting a gas and wherein the gas is injected into the bore hole from the drill string adjacent the control means within the first straight section of the bore hole.

11. The method according to claim 10 wherein the first straight section of the bore hole includes a cylindrical casing.

12. The method according to claim 1 wherein the first straight section is substantially vertical and wherein the straight portion is substantially horizontal.

13. A method of drilling a bore hole in the earth wherein the bore hole includes a first substantially straight portion extending from ground level to a first below ground location and a curved portion extending from the first below ground location to a second below ground location, the method comprising:

providing a drill string having a trailing end at ground level and a leading end for insertion into the bore hole;

connecting a supply of drilling fluid to the trailing end for pumping the drilling fluid to the leading end;

providing a drilling tool having an elongate tool body defining a longitudinal axis therealong, providing a motor mounted on the tool body to generate drive power, providing a drill bit mounted on the tool body at a leading end thereof for rotation of the drill bit in an angular direction relative to the tool body about the longitudinal axis in responsive to the drive power from the motor, and providing means forming a bend section in the tool body defining a bend axis of the tool body transverse to the longitudinal axis of the tool body such said rotation of the drill bit tends to steer a longitudinal drilling direction of the tool body in a direction at an angle to a plane containing the bend axis and the longitudinal axis;

connecting a trailing end of the drilling tool body to the leading end of the drill string so as to communicate drilling fluid from the drill string to the tool body to cause rotation of the drill bit;

in order to form a straight section of the bore hole extending from the second below ground location, causing counter-rotation of the tool body relative to the leading end of the drill string in an angular direction opposite to the angular direction of the drill bit so as to cause rotation of the tool body and the transverse bend axis about the longitudinal axis, and providing control means for controlling the counter-rotation to be maintained during the formation of the straight section at a rate less than that of the rotation of the drill bit;

wherein the control means is located in the first substantially straight portion spaced downwardly from the ground surface and is interconnected to the tool body by a length of tubing extending through the curved section such that the length of tubing counter-rotates with the tool body relative to the drill string and relative to the curved section of the bore hole.

14. The method according to claim 13 wherein the drill string includes means for transporting a gas and wherein the gas is injected into the bore hole from the drill string adjacent the control means within the first straight section of the bore hole.

15. The method according to claim 14 wherein the first straight section of the bore hole includes a cylindrical casing.

16. The method according to claim 13 wherein the first straight section is substantially vertical and wherein the second straight portion is substantially horizontal.

* * * * *